US009126787B2

(12) United States Patent
Adachi et al.

(10) Patent No.: US 9,126,787 B2
(45) Date of Patent: Sep. 8, 2015

(54) RECORDING MEDIUM SETTING DEVICE AND IMAGE FORMING APPARATUS

(71) Applicants: Hiroshi Adachi, Kanagawa (JP); Yuji Ikeda, Kanagawa (JP)

(72) Inventors: Hiroshi Adachi, Kanagawa (JP); Yuji Ikeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/296,988

(22) Filed: Jun. 5, 2014

(65) Prior Publication Data

US 2014/0374983 A1 Dec. 25, 2014

(30) Foreign Application Priority Data

Jun. 24, 2013 (JP) ..... 2013-132054

(51) Int. Cl.

| | |
|---|---|
| ***B65H 1/00*** | (2006.01) |
| ***B65H 9/20*** | (2006.01) |
| ***B65H 9/18*** | (2006.01) |
| ***B65H 7/20*** | (2006.01) |

(52) U.S. Cl.

CPC .. *B65H 9/20* (2013.01); *B65H 7/20* (2013.01); *B65H 9/18* (2013.01); *B65H 2405/1144* (2013.01); *B65H 2405/11425* (2013.01); *B65H 2511/12* (2013.01)

(58) Field of Classification Search

CPC .... B65H 1/00; B65H 1/04; B65H 2405/1122; B65H 2405/1134; B65H 2405/11425; B65H 2405/1144; B65H 2511/00; B65H 2511/10; B65H 2511/12; B65H 2511/40; B65H 2701/1131; B65H 2404/70; B65H 2404/722; B65H 2404/724; B65H 2404/725; B65H 7/20; B65H 9/18; B65H 9/20

See application file for complete search history.

(56) References Cited

U.S. PATENT DOCUMENTS

| | | | | |
|---|---|---|---|---|
| 6,089,566 | A * | 7/2000 | Xu et al. | 271/265.01 |
| 8,530,800 | B2 | 9/2013 | Adachi et al. | |
| 8,820,734 | B2 * | 9/2014 | Miyakawa et al. | 271/171 |
| 2008/0061634 | A1 | 3/2008 | Iwata et al. | |
| 2011/0175282 | A1 * | 7/2011 | Sagawa et al. | 271/258.01 |
| 2013/0200565 | A1 | 8/2013 | Takenaka et al. | |
| 2013/0270765 | A1 * | 10/2013 | Araaki et al. | 271/171 |
| 2013/0341854 | A1 * | 12/2013 | Miyakawa et al. | 271/145 |

FOREIGN PATENT DOCUMENTS

| | | |
|---|---|---|
| JP | 3969215 | 9/2007 |

* cited by examiner

*Primary Examiner* — Prasad Gokhale

(74) *Attorney, Agent, or Firm* — Oblon, McClelland, Maier & Neustadt, L.L.P.

(57) ABSTRACT

A recording medium setting device includes a base plate on which recording media are set; guide members being moved in a width direction of the recording media that are set on the base plate; a contact detection unit detecting a contact between the guide members and the recording media; an approach unit moving the guide members in a direction so as to sandwich the recording media set on the base plate until the contact detection unit detects the contact between the guide members and the recording media; and an additional approach unit moving the guide members, moved by the approach unit, at a predetermined distance in the direction to squeeze the recording media after the contact detection unit detects the contact between the guide members and the recording media.

12 Claims, 4 Drawing Sheets

RECORDING MEDIUM SETTING DEVICE AND IMAGE FORMING APPARATUS

CROSS-REFERENCE TO RELATED APPLICATIONS

The present application is based on and claims the benefit of priority under 35 U.S.C §119 of Japanese Patent Application No. 2013-132054 filed Jun. 24, 2013, the entire contents of which are hereby incorporated herein by reference.

BACKGROUND OF THE INVENTION

1. Field of the Invention

The present invention generally relates to a recording medium setting device having a function of arranging unevenly-stacked recording media in order, the recording media being set by a user and including sheets etc., and an image forming apparatus having the recording medium setting device.

2. Description of the Related Art

An image forming apparatus such as a copier, a facsimile machine, a multifunction peripheral, etc., generally includes a sheet setting device, as a recording medium setting device, on which sheets are stacked. In order words, an image forming apparatus generally includes, for example, a sheet feeding cassette on which sheets are set or a draft tray on which drafts to be read are set.

Further, such sheet setting device generally includes a pair of (i.e., two) movable guide members (side fences) facing each other that are provided for arranging the sheets (e.g., print sheets or drafts to be read) which are set thereon and detecting the size of the sheets.

The movable guide members (side fences) move in a manner such that one guide member and the other guide member move in conjunction with each other and the moving direction of the one guide member is opposite to the moving direction of the other guide member in the sheet width direction (which is orthogonal to the sheet supply direction or the sheet feeding direction). Further, the guide members are generally moved (operated) manually by a user. However, to simplify (help) the user's operation, there are known guide members that can be moved automatically. Namely, Japanese Patent No. 3969215 discloses a control method in which when drafts are set, a pair of (i.e., two) guide members are automatically moved in the direction so that the guide members approach each other. Then, when the guide member(s) is in contact with the draft(s) (sheet(s)), the movement of the guide members is stopped.

SUMMARY OF THE INVENTION

According to an aspect of the present invention, a recording medium setting device includes a base plate on which recording media are set; guide members being moved in a width direction of the recording media that are set on the base plate; a contact detection unit detecting a contact between the guide members and the recording media; an approach unit moving the guide members in a direction so as to sandwich the recording media set on the base plate until the contact detection unit detects the contact between the guide members and the recording media; and an additional approach unit moving the guide members, moved by the approach unit, at a predetermined distance in the direction to squeeze the recording media after the contact detection unit detects the contact between the guide members and the recording media.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In related technologies, for example, according to the automatic movement of the guide members in the control method in Japanese Patent No. 3969215, the movement of the guide members is automatically stopped as soon as the guide member detects the contact with a sheet. However, in a case where many sheets are unevenly stacked, it may be difficult to arrange (set) in order the unevenly-stacked sheets.

Namely, when sheets are unevenly-stacked, that is, for example, some sheets may be obliquely rotated or displaced in the width direction so that some sheets are displaced toward one guide member and some other sheets are displaced toward the other guide member. In such a case, if the movement of the guide members is stopped when the guide member(s) is in contact with a sheet, the guide members may be stopped in a manner such that the width between the guide members is greater than the desired with (i.e., the actual sheet width). As a result, the sheet size may be incorrectly detected, so that the sheet feed may be started under the condition of the incorrect sheet size detection or unevenly-stacked sheets. Due to this, a print failure or a sheet feeding failure may occur.

In other words, the automatic movement of the guide members in related technologies is to reduce (help) user's operation load to move the guide member only. More specifically, no attention is paid to whether the sheets may be unevenly stacked and no operation is performed to arrange the unevenly-stacked sheets in order.

The present invention is made in light of the above problem and may provide a recording medium setting device that can arrange in order the unevenly-stacked recording media that are set thereon.

According to an embodiment, it may become possible to arrange (set) in order the unevenly-stacked recording media that are set in an image forming apparatus.

In the following, embodiments of the present invention are described with reference to the accompanying drawings.

Example Configuration of an Image Forming Apparatus

Figure 1:
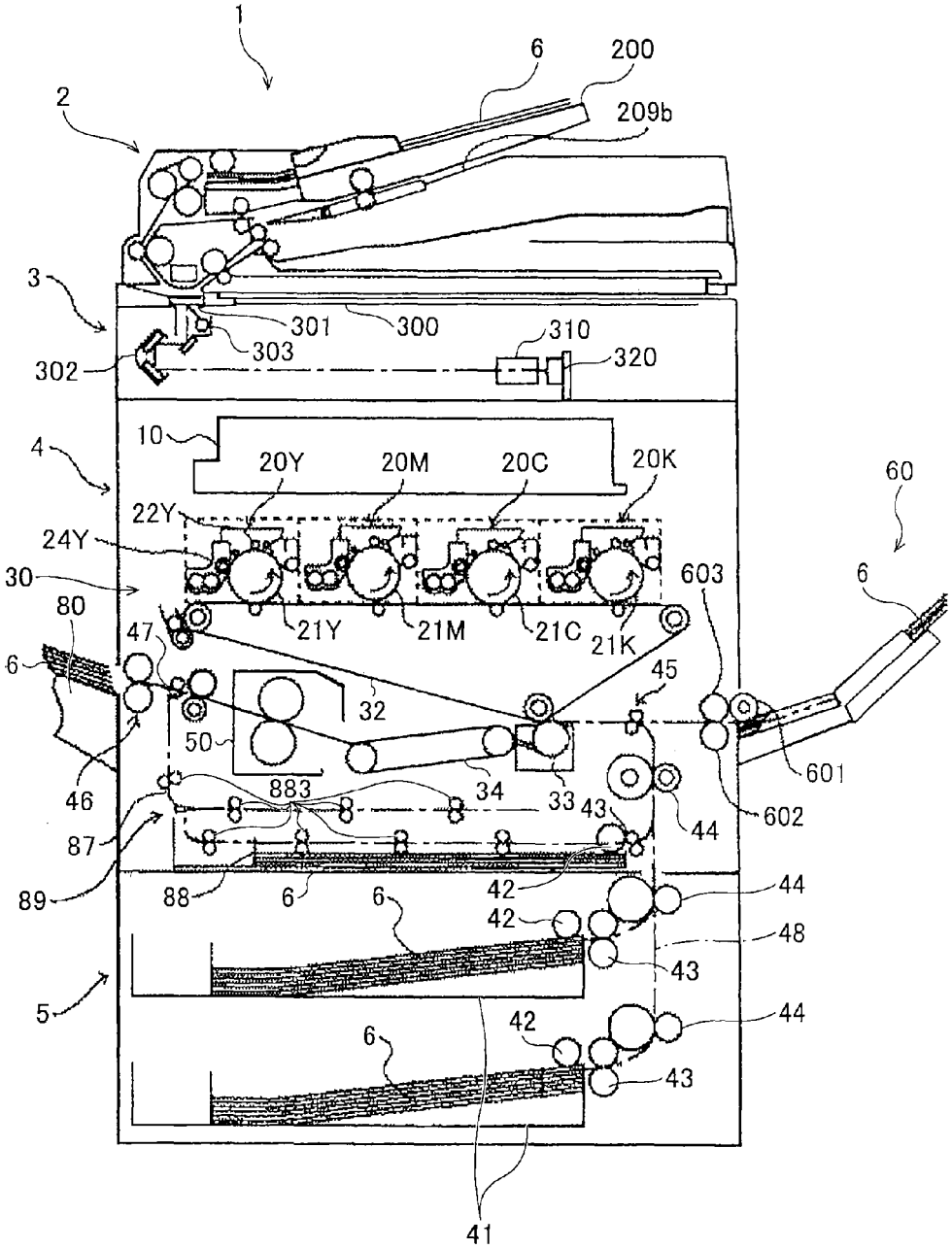
FIG. 1 schematically illustrates an example configuration of an image forming apparatus according to an embodiment.

FIG. 1 schematically illustrates an example configuration of an image forming apparatus according to an embodiment. As schematically illustrated in FIG. 1, an image forming apparatus 1 is a copier which includes an automatic draft feeder (ADF) 2, a scanner 3, an image forming section 4, and a sheet feeding section 5.

The sheet feeding section 5 includes a sheet feeding cassette 41 which contains (stores) sheets 6 as print sheets on which an image is formed. Further, the image forming section 4 includes four process cartridges 20Y, 20M, 20C, and 20K for forming respective yellow (Y), magenta (M), cyan (C), and black (K) toner images.

The image forming section 4 includes a transfer device 30 in the middle part in the vertical direction thereof. The transfer device 30 includes an intermediate transfer belt 32, which is an endless belt serving as an intermediate transfer body, and a plurality of rollers which are disposed within the loop formed thereby so that the intermediate transfer belt 32 is stretched in an upside-down triangle shape by the rollers.

At three apexes of the triangle shape, the respective supporting rollers are provided so that the intermediate transfer belt 32 is wound around the outer-periphery surfaces of the respective rollers at large wound angles. Further, one of the supporting rollers is driven to rotate to endlessly move the intermediate transfer belt 32 in the clockwise direction in FIG. 1.

Further, at the left end of the apex of the triangle shape of the intermediate transfer belt 32 in FIG. 1, a belt cleaning device is provided to be in contact with the loop (i.e., the intermediate transfer belt 32) from outside of the loop.

The belt cleaning device cleans the intermediate transfer belt 32 by removing remaining toner after transfer from the surface of the intermediate transfer belt 32, the remaining toner after transfer being attached to the surface of the intermediate transfer belt 32 after the intermediate transfer belt 32 passes the secondary transfer nip (described below).

After passing the area where intermediate transfer belt 32 is in contact with the left end supporting roller in FIG. 1, the intermediate transfer belt 32 moves in a horizontal feed area where the intermediate transfer belt 32 substantially horizontally moves towards the area where intermediate transfer belt 32 is in contact with the right end supporting roller in FIG. 1.

Above the horizontal feed area, there are the four process cartridges 20Y, 20M, 20C, and 20K arranged in this order along the belt feeding direction. The process cartridges 20Y, 20M, 20C, and 20K sequentially superimpose and transfer Y, M, C, and K color toner images on the on the intermediate transfer belt 32.

The image forming apparatus in FIG. 1 has a tandem type configuration in a manner such that the process cartridges 20Y, 20M, 20C, and 20K form the respective Y, M, C, and K color toner images in a parallel way. It should be noted that the order of Y, M, C, and K in FIG. 1 is an example only. Namely, the present invention is not limited to this arranging order of the process cartridges 20.

In the image forming section 4, the process cartridges 20Y, 20M, 20C, and 20K include respective drum-shaped photosensitive bodies 21Y, 21M, 21C, and 21K as the image carriers. Further, there are charging devices (22Y, etc.), developing devices (24Y, etc.), photosensitive body cleaning devices, and discharging devices around the respective photosensitive bodies 21Y, 21M, 21C, and 21K.

Above the process cartridges 20Y, 20M, 20C, and 20K, there is provided an exposure device 10. The exposure device 10 in combination with the charging devices (22Y, etc.) constitutes a latent image forming part that forms the respective electrostatic latent images on the photosensitive bodies 21Y, 21M, 21C, and 21K.

The exposure device 10 optically scans the surfaces of the uniformly-charged photosensitive bodies 21Y, 21M, 21C, and 21K, which are driven to rotate in the counter-clockwise direction in FIG. 1, by using respective Y, M, C, and K writing light generated based on image information acquired by image reading using the scanner 3 or image information transmitted from a personal computer or the like.

The electrostatic latent images, which are for the Y, M, C, and K color images, carried on the surfaces of the photosensitive bodies 21Y, 21M, 21C, and 21K are visualized to be the respective Y, M, C, and K toner images when Y, M, C, and K toner is adhered to the surfaces by the developing devices (24Y, etc.). The photosensitive bodies 21Y, 21M, 21C, and 21K are in contact with the intermediate transfer belt 32 to form Y, M, C, and K primary transfer nips (primary transfer nip portions).

On the rear (opposite) side of the Y, M. C, and K primary transfer nips, there are provided respective primary transfer rollers in the loop of the intermediate transfer belt 32, so that the intermediate transfer belt 32 is sandwiched between the photosensitive bodies 21Y, 21M, 21C, and 21K and the respective primary transfer rollers.

Further, in the Y Primary transfer nip, the Y toner image formed on the photosensitive body 21Y is primarily transferred onto a front surface of the intermediate transfer belt 32. The surface of the intermediate transfer belt 32 on which the Y toner image is primarily transferred sequentially passes through the M, C, and K primary transfer nips.

During the passing (processes), the M, C, and K toner images on the photosensitive bodies 21M, 21C, and 21K are sequentially superimposed and primarily transferred onto the surface of the intermediate transfer belt 32 on which the Y toner image is primarily transferred, so that a color toner image is formed on the surface of the intermediate transfer belt 32.

The surfaces of the photosensitive bodies 21Y, 21M, 21C, and 21K after passing through the respective Y, M, C, and K primary transfer nips are cleaned by the photosensitive body cleaning devices, so that the remaining toner after transfer are cleaned (removed). After that, the surfaces are discharged by the respective discharging devices for preparing for another image forming.

Further, at the bottom end of the apex of the triangle shape of the intermediate transfer belt 32 in FIG. 1 (i.e., at the portion where intermediate transfer belt 32 winds around the supporting roller that is disposed on the lowest position among the three supporting rollers within the loop of the intermediate transfer belt 32), a secondary transfer roller 33 is provided as a secondary transfer part which is in contact with the loop of the intermediate transfer belt 32 from outside of the loop to form a secondary transfer nip.

On the right side of the secondary transfer nip in FIG. 1, there is provided a pair of resist rollers 45 where the rollers are in contact with each other, forming a resist nip therebetween, and rotating each other in the forward direction. The sheet 6 fed from the sheet feeding section 5 enters into the resist nip to be sandwiched between the resist rollers 45. The sheet 6 is further fed by the resist rollers 45 to the secondary transfer nip at the timing in synchronization with the color toner image on the intermediate transfer belt 32.

The color toner image is secondarily transferred onto the sheet 6, which is sandwiched in the secondary transfer nip, by the operations of a secondary transfer electric field and a nip pressure. The sheet 6 on which the color toner image is secondarily transferred as described above is further fed from the secondary transfer nip into a fixing device 50 via an endlessly moving feeding belt 34.

The fixing device 50 performs a fixing process on the sheet 6, which is sandwiched at a fixing nip formed by a contact between a fixing roller and a press roller serving as a fixing member of the fixing device 50, to fix the toner image by heating and pressing the sheet 6 in the fixing device 50.

The sheet 6 fed from the fixing device 50 is further fed at a feed path branching point where a feed path switching craw 47 is disposed. The feed path switching craw 47 selects (switches) the sheet feeding path on the downstream side therefrom by selecting either a discharge path or a reverse feeding path 87. When the one-side print mode is selected as the print mode, the feed path switching craw 47 selects the discharge path as the sheet feeding path.

Also, when the both-sided print mode is selected and both sides of the sheet 6 fed from the secondary transfer nip carry a toner image, feed path switching craw 47 selects the discharge path as the sheet feeding path. The sheet 6 entering the discharge path passes through a discharge nip of a pair of discharge rollers 46 to be discharged outside. The discharged sheets 6 are stacked on a discharge tray 80.

On the other hand, when the both-sided print mode is selected and only one of the sides of the sheet 6 fed from the secondary transfer nip carries a toner image, feed path switching craw 47 selects the reverse feeding path 87 as the sheet feeding path. In this case, in the both-sided print mode, after being fed from the fixing device 50, the sheet 6 where only a first surface thereof carries a toner image enters the reverse feeding path 87. In the reverse feeding path 87, there is provided a reverse feeding apparatus 89.

The reverse feeding apparatus 89 reverses the sheet 6 upside down (i.e., turns over the sheet 6) and temporarily stacks the sheet 6 in a relay tray 88 or further feeds the sheet 6 to the resist rollers 45 again. The sheet 6 which is fed back to the sheet feeding path 48 by the reverse feeding apparatus 89, is further fed to the secondary transfer nip again by the resist rollers 45, so that a toner image is secondarily transferred onto a second surface of the sheet 6 as well. Then, the sheet 6 sequentially passes through the fixing device 50, the feed path switching craw 47, the discharge path, and the discharge rollers 46 to be stacked on the discharge tray 80.

The sheet feeding section 5, just below the image forming section 4, includes the sheet feeding cassette 41, the sheet feeding path 48, and a plurality of feed rollers 44. The sheet feeding cassette 41, which serves as the recording medium setting device, is detachably mounted by being slidably moved in the front-back direction relative to the chassis of the sheet feeding section 5 (or in a direction orthogonal to the figure surface).

The bundle of the sheets 6 (sheet bundle) in the sheet feeding cassette 41 set in the chassis of the sheet feeding section 5 is pressed by a sheet feed roller 42 supported by a supporting means in the chassis. In this state, when the sheet feed roller 42 is driven to rotate, the sheet 6 at the top of the sheet bundle is fed into the sheet feeding path 48. Then, the sheet 6 passes through the feed nips of the respective pair of feed rollers 44 to be fed to the resist nip of the resist rollers 45 in the image forming section 4.

The side surface on the right side of the image forming section 4 in FIG. 1 supports a manual tray 60 as a sheet set device. On the manual tray 60, the sheet 6 at the top of the sheet bundle is pressed by a manual sheet feed roller 601. When the manual sheet feed roller 601 is driven to rotate, the sheet 6 at the top of the sheet bundle on the manual tray 60 is fed to the resist rollers 45.

The fed sheet 6 passes a feed separation nip, which is formed by the contact between a feed roller 603 and a separation roller 602, before being fed to the resist rollers 45 so as to make sure that only one sheet is fed to the resist rollers 45.

Below a first contact glass 300 and a second contact glass 301 of the scanner 3, the scanner 3 further includes a travelling body 302, an imaging lens 310, and an image read sensor 320. The travelling body 302 includes a scan lamp 303 and a plurality of reflection mirrors, and is movable in the horizontal direction in FIG. 1.

The light from the scan lamp 303 is reflected from an imaging surface of a draft set on the first contact glass 300 or a draft which is being fed on the second contact glass 301 to become image read light. The image read light is reflected by the reflection mirrors mounted on the travelling body 302 and incident onto the image read sensor 320, which is a charged coupled device (CCD), etc., via the imaging lens 310 to form an image at the focal position of the image read sensor 320. By doing this, an image can be read.

When the scanner 3 reads an image on the sheet 6 set in the automatic draft feeder (ADF) 2, while the travelling body 302 is stopped at the position of FIG. 1, the scan lamp 303 is turned on to irradiate the light from the scan lamp 303 toward the second contact glass 301. In this case, the ADF 2 starts feeding the sheet 6, which is set on a draft tray 200 provided as the recording medium setting device, to pass the sheet 6 right above the second contact glass 301 of the scanner 3.

By doing this, while the travelling body 302 is stopped, the image on the sheet 6 can be sequentially read from the header end side to the back end side in the feed direction of the sheet 6. After the reading of the image is finished, the sheet 6 is moved onto a discharge tray 209*b* to be stacked there.

Example Configuration of Sheet Setting Device

Figure 2:
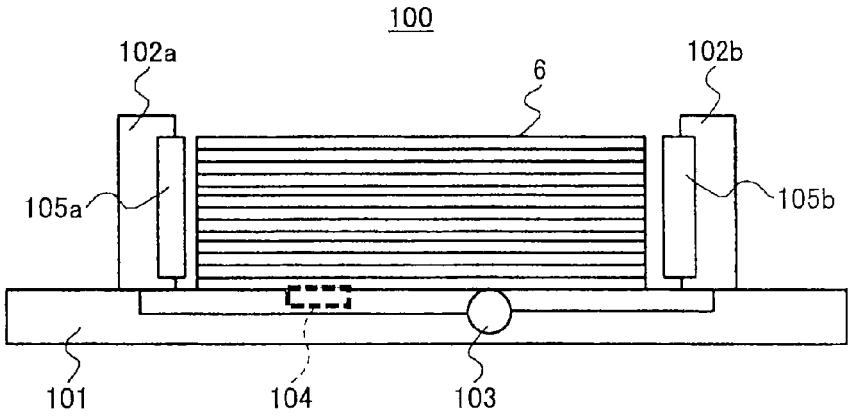
FIG. 2 illustrates an example configuration of a sheet setting device according to an embodiment.

FIG. 2 illustrates an example configuration of a sheet setting device in the image forming apparatus 1. The sheet setting device is applied as the draft tray 200, the manual tray 60, and the sheet feeding cassette 41 in FIG. 1.

A sheet setting device 100, which serves as the recording medium setting device, includes a sheet table 101, which serves as a placing table, on which the sheets 6 are to be set, side fences 102*a* and 102*b* facing each other, which serve as guide members, to fix (control) the position and direction of the sheets 6 to avoid a sheet feed failure, and a side fence drive motor 103 to drive the side fences 102*a* and 102*b*.

The sheet setting device 100 further includes a sheet set detection sensor 104, which serves as a recording medium detect part, to detect that the sheets 6 as the recording media are set and sheet contact sensors 105*a* and 105*b*, which serve as contact detection parts, to detect a contact between the sheet 6 and the side fences 102*a* and 102*b*, respectively.

As the sheet contact sensors 105*a* and 105*b*, analog output sensors are used, capable of not only detecting a contact with the sheet 6 but also measuring the distances between the side fences 102*a* and 102*b* and the sheet 6. As the analog-output sensor, for example, there is a linear output magnetic sensor which is made of a hole element and magnet.

Further, by driving the side fence drive motor 103, the side fences 102*a* and 102*b* are moved in the width direction of the sheet 6 (i.e., in the direction orthogonal to the sheet feed direction or the feed direction) in a manner that the side fences 102*a* and 102*b* move in the directions opposite to each other in the same distance.

Further, based on the outputs from the sheet contact sensors 105*a* and 105*b*, the rotational direction and the of the rotation amount of the side fence drive motor 103 are determined and set. By doing this, the positions of the sheet contact sensors 105*a* and 105*b* can be precisely controlled so that it becomes possible to perform positional control for more appropriately arranging the sheets in order. To that end, as the side fence drive motor 103, it is preferable to use a stepping motor or a motor having an encoder detection function.

Figure 3:
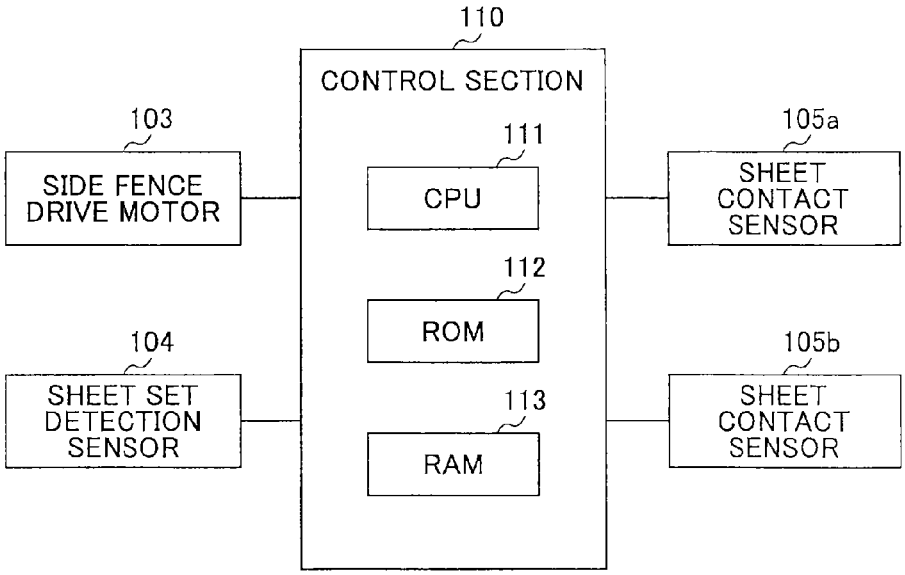
FIG. 3 is an example configuration of a control system of the sheet setting device according to an embodiment.

FIG. 3 is a block diagram of an example configuration of a control system of the sheet setting device 100. As illustrated in FIG. 3, the side fence drive motor 103, the sheet set detection sensor 104, and the sheet contact sensors 105*a* and 105*b* are connected to a control section 110 which includes a Central Processing Unit (CPU) 111, a Read Only Memory (ROM)

112, and a Random Access Memory (RAM) 113. The control section 110 executes (controls) an automatic sheet setting operation, which is described below, by processing a program stored in the ROM 112 and a hard disk (not shown) in the image forming apparatus 1.

Automatic Sheet Setting Operation in the Sheet Setting Device

Figure 4:
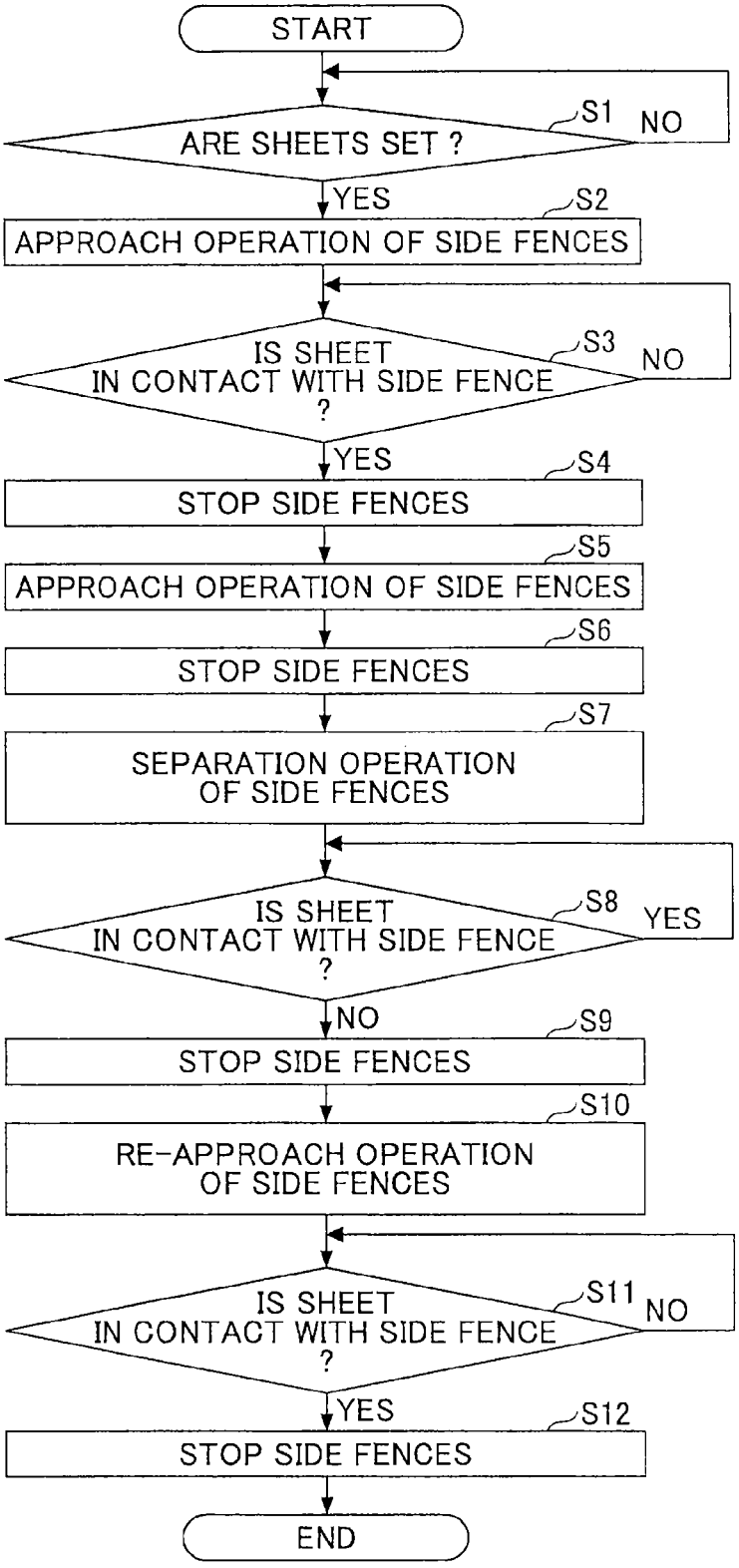
FIG. 4 is an example flowchart of an operation procedure of the sheet setting device according to an embodiment.

FIG. 4 is a flowchart of an example procedure of the sheet setting device 100 according to an embodiment. The flow starts when the power of the image forming apparatus 1 is turned on.

First, the CPU 111 determines whether the sheets 6 are set based on the output from the sheet set detection sensor 104 (step S1). When determining that the sheets 6 are set (YES in step S1), the CPU 111 executes an approach operation of the side fences 102*a* and 102*b* (step S2). Namely, the CPU 111 causes the side fence drive motor 103 to rotate so that the side fences 102*a* and 102*b* approach each other. Herein, the term "approach operation" refers to an operation to move the side fences 102*a* and 102*b* so as to approach each other in the approaching direction (i.e., in the direction to sandwich (squeeze) the sheets 6)

After that, based on the outputs from the sheet contact sensors 105*a* and 105*b*, the CPU 111 determines whether one the side fences 102*a* and 102*b* is in contact with the sheet 6 (step S3). When determining that one of the side fences 102*a* and 102*b* is in contact with the sheet 6 (YES in step S3), the CPU 111 stops the side fence drive motor 103 to stop the movements of the side fences 102*a* and 102*b* (step S4).

Here, the CPU 111 and the side fence drive motor 103 function as an approaching means. Further, herein, it is determined that at least one of the side fences 102*a* and 102*b* is in contact with the sheet 6 when at least one of the sheet contact sensors 105*a* and 105*b* detects the contact with the sheet 6. Further, the contact with the sheet 6 by the side fences 102*a* and 102*b* is determined when the distance between the side fences 102*a* and 102*b* and the sheet 6 is zero.

Next, the CPU 111 further executes the approach operation at a predetermined distance on the side fences 102*a* and 102*b* (step S5), and stops the movements of the side fences 102*a* and 102*b* (step S6). Namely, the CPU 111 causes the side fence drive motor 103 to rotate until the side fences 102*a* and 102*b* approach each other at the predetermined distance, so that, when the side fences 102*a* and 102*b* approach each other at the predetermined distance, the CPU 111 stops the rotation of the side fence drive motor 103.

In this case, the processes of steps S4 and S5 may not be executed. Namely, after it is determined that at least one the side fences 102*a* and 102*b* is in contact with the sheet 6 in step S3, the side fences 102*a* and 102*b* may be controlled to approach each other at the predetermined distance and then the process of step S6 may be executed next.

Hereinafter, the above "approach operation at a predetermined distance" in which the side fence drive motor 103 causes the side fences 102*a* and 102*b* to approach each other at a predetermined distance after the contact of at least one of the side fences 102*a* and 102*b* with the sheet 6 is detected may be called an "additional approach operation" or a "sheet arranging operation".

In this regard, the CPU 11 and the side fence drive motor 103 function as an additional approach means. Here, as an example of the "predetermined distance", a distance in one side may be 0.8 mm (i.e., a distance in both sides may be 0.8 mm×2=1.6 mm).

Next, the CPU 111 executes a separation operation of the side fences 102*a* and 102*b* (step S7). Namely, the CPU 111 causes the side fence drive motor 103 to rotate to separate the side fences 102*a* and 102*b* from each other. Namely, the "separation operation" herein refers to an operation to move the side fences 102*a* and 102*b* in the direction to be separated from each other (in the direction opposite to the direction to sandwich (squeeze) the sheets 6).

Next, based on the outputs from the sheet contact sensors 105*a* and 105*b*, the CPU ill determines whether the side fences 102*a* and 102*b* are in contact with the sheet 6 (step S8). Then, when determining that the side fences 102*a* and 102*b* are not in contact with the sheet 6 (i.e., the side fences 102*a* and 102*b* are separated from the sheet 6) (NO in step S8), the CPU 111 stops the rotation of the side fence drive motor 103 to stop the movements of the side fences 102*a* and 102*b* (step S9). In this regard, the CPU 111 and the side fence drive motor 103 function as a separation means.

Next, the CPU 111 executed a "re-approach operation" of the side fences 102*a* and 102*b* (step S10). Namely, the CPU 111 causes the side fence drive motor 103 to rotate so that the side fences 102*a* and 102*b* approach each other. After that, based on the outputs of the sheet contact sensors 105*a* and 105*b*, the CPU 111 determines whether at least one of the side fences 102*a* and 102*b* is in contact with the sheet 6 (step S11).

Then, when determining that at least one of the side fences 102*a* and 102*b* is in contact with the sheet 6 (YES in step S11), the CPU 111 stops the rotation of the side fence drive motor 103 to stop the movements of the side fences 102*a* and 102*b* (step S12). In this regard, the CPU 111 and the side fence drive motor 103 function as a re-approach means.

Figure 5:
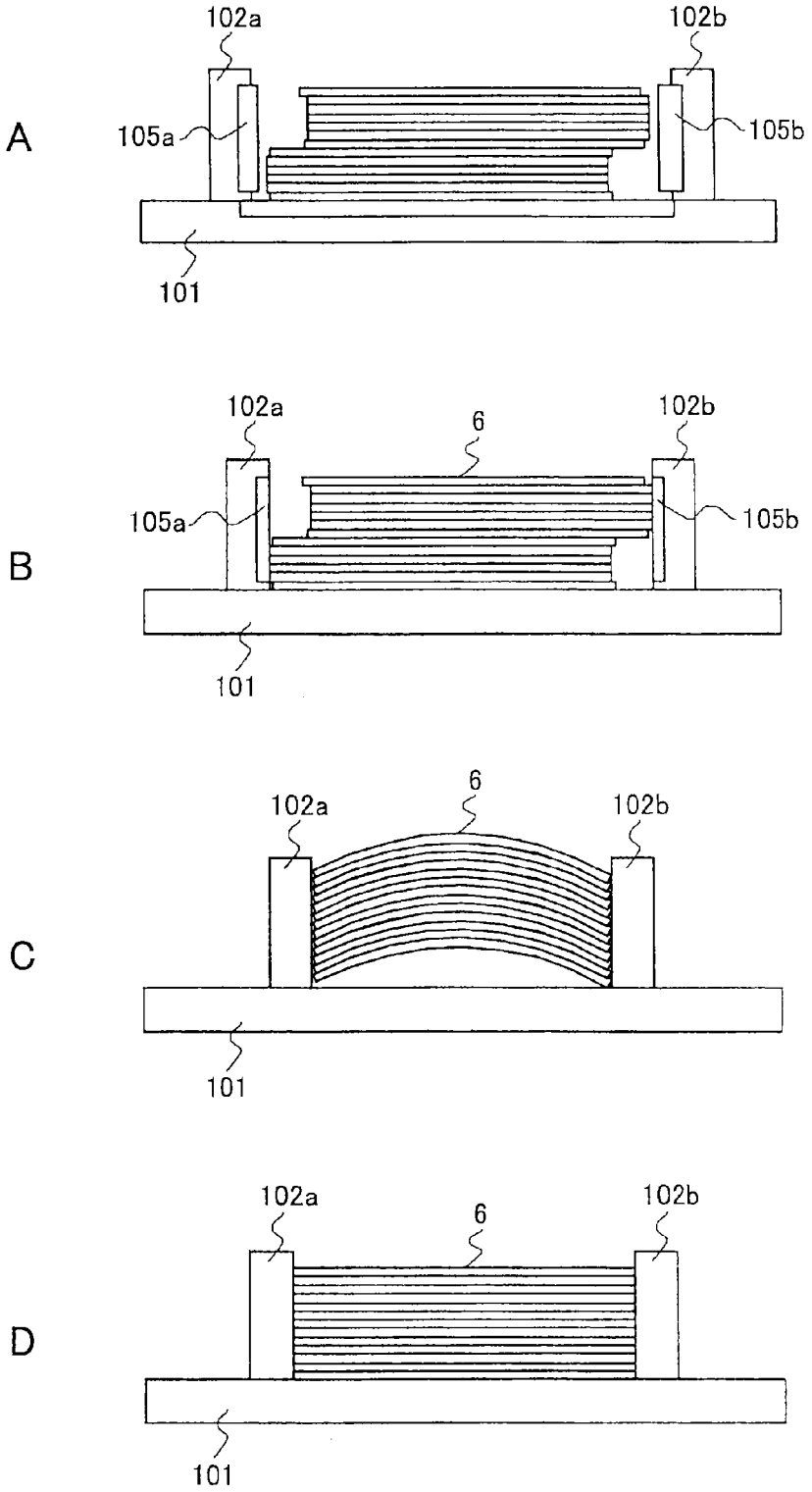
FIG. 5 schematically illustrates an example operation of the sheet setting device according to an embodiment.

FIG. 5 illustrates an example operation of the sheet setting device 100 according to an embodiment.

In a case where the sheets 6 set in the sheet setting device 100 are unevenly stacked so that some sheets protrude out of the stack on both sides as shown in part A of FIG. 5, when the process of step S3 of FIG. 4 is executed, only the sheets protruding on both sides are detected. As a result, in step S4, as shown in part B of FIG. 5, the side fences 102*a* and 102*b* may be stopped even when some of the sheets 6 are unevenly stacked. If the sheets in this state are fed, a print failure or a feed failure may occur.

To overcome the problem, first, in the processes of steps S5 and S6, the "approach operation at a predetermined distance" in which the side fence drive motor 103 approach each other at a predetermined distance is performed to arrange the sheets 2 in order. However, as a result, as shown in part C of FIG. 5, it is expected that the sheets 6 be bent.

To resolve the problem, in steps S7, S8, and S9, the side fences 102*a* and 102 are separated from each other until the side fences 102*a* and 102 are not in contact with the sheets 6. Then, in steps S10, S11, and S12, the side fences 102*a* and 102 are driven to approach each other until the side fences 102*a* and 102 are in contact with the sheets 6.

By doing this, as shown in part D of FIG. 5, it becomes possible to determine the positions of the side fences 102*a* and 102 to arrange in order the sheets 6 in their appropriate positions, that is, without bending any of the sheets 6. Further, the sheet arrange operation (in steps S5 through S12) may be executed only once or may be repeated two or more times. However, in this embodiment, in view of the combination of the easiness of arranging in order the sheets 6 and the user's wait time, the arrange operation is executed twice.

As described above, in the sheet setting device 100 according to an embodiment, the "approach operation at a predetermined distance" is performed. Due to the operation, it becomes possible to arrange in order the sheets 6 which are unevenly stacked. Further, due to the "separation operation" and the "re-approach operation", even when the sheets 6 are bent due to the "additional approach operation" (i.e., the "approach operation at a predetermined distance"), it becomes possible to remove the bend of the sheets 6 and arrange in order the sheets 6 at the appropriate position.

Therefore, in the image forming apparatus 1 including the sheet setting device 100 according to an embodiment, it becomes possible to effectively prevent a sheet feed failure and a print failure which may be caused by the unevenly stacked sheets 6.

It should be noted that the present invention is not limited to the embodiments described above. For example, the present invention may also be applied to the following modifications (1) through (8).

Modification (1)

When the sheets 6 are unevenly stacked, a necessary distance (force) for the "approach operation" varies depending on the friction force, the weight, and the number of the sheets 6. Namely, for example, when one hundred sheets 6 are set, due to an increased friction force between the sheets 6, it becomes more difficult to handle the sheets.

Therefore, the predetermined distance and the number of the "approach operation at a predetermined distance" may be controlled based on a type of the sheets 6 and the stacked number of the sheets 6. The data of the sheet type and the stacked number of the sheets 6 may be reported to the CPU 111 by using sensors mounted in the sheet setting device 100 or may be designated by inputting via an operation panel of the image forming apparatus 1 by a user.

Modification (2)

The sheets 6 may be displaced again during the vibration caused by sheet feed. Namely, the sheet setting device 100 is vibrated by a print process, so that the sheets 6, which have been arranged in order at the appropriate position, may be displaced again. Further, even when the "approach operation" is executed, due to, for example, the friction force interaction between the sheets 6, the sheet arrangement in order may not be sufficiently completed. Therefore, it may be preferable to execute the "sheet arrange operation" again when a predetermined number of sheets 6 are printed.

In this case, the CPU 111 may control and manage the print operations including, for example, the detection that the predetermined number of the sheets 6 are printed. Otherwise, for example, another CPU (e.g., the CPU that controls the entire operations of the image forming apparatus 1) may control and manage the print operation.

Modification (3)

The sheet arrange operation may be executed only at an (more) appropriate timing. To that end, the sheet arrange operation is controlled to be executed only at a timing when the sheets are displaced, that is, for example, when any of the sheet contact sensors 105*a* and 105*b* detects a separation of the sheets from the side fences 102*a* and 102*b* during printing.

Modification (4)

In a case where the sheet arrange operation is executed during the printing, the sheet arrange operation during the sheet feed from the sheet table 101 may cause a sheet feed failure. Therefore, it is effective to control so that the sheet arrange operation be prevented during a predetermined time period from when the sheet feed of the sheet 6 is started.

Further, it may be more preferable to vary the predetermined time period based on the detected size of the sheets 6. By doing this, it becomes possible to execute the sheet arrange operation at an appropriate timing based on the sheet size.

Modification (5)

In a case where the sheet arrange operation is executed during the printing, if the sheet arrange operation is executed while the last of the sheets 6, which have been set, is being fed, the side fences 102*a* and 102*b* are unnecessarily driven to move (open and close operations), causing a sheet size detection failure as well.

To prevent this problem, it is preferable to control so that the sheet arrange operation be prevented when the sheet set detection sensor 104 does not detect any sheets that are set based on a detection signal thereof.

Modification (6)

It may be preferable that the movement of only one of the side fences 102*a* and 102*b* is automatically controlled by being driven by a motor and the movement of the other of the side fences 102*a* and 102*b* is prevented, so it is to be fixed to its position or manually controlled.

Modification (7)

When the sheet setting device 100 is provided as the draft tray 200 or the manual tray 60, the approach operation of the side fences 102*a* and 102*b* (step S2 in FIG. 4) may be started in response to a user's predetermined operation (e.g., inputting instructions to start sheet setting, or pressing "copy" (start) button).

Modification (8)

When the sheet setting device 100 is provided as the sheet feeding cassette 41, the approach operation of the side fences 102*a* and 102*b* (step S2 in FIG. 4) may be started in response to the detection that the sheet feeding cassette 41 is set in the sheet feeding section 5.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A recording medium setting device in an image forming apparatus configured to perform printing on recording media fed from the recording medium setting device, the device comprising:

a base plate on which recording media are set;

guide members configured to be moved in a width direction of the recording media that are set on the base plate;

a contact detection unit configured to detect a contact between the guide members and the recording media; and circuitry configured to:

move the guide members, perform an approach operation by moving the guide members in a direction so as to sandwich the recording media set on the base plate until the contact detection unit detects the contact between the guide members and the recording media, perform an additional approach operation by moving the guide members, moved in the approach operation, at a predetermined distance in the direction to squeeze the recording media after the contact detection unit detects the contact between the guide members and the recording media, and move the guide members when an image forming unit of the image forming apparatus performs printing.

2. The recording medium setting device according to claim 1, wherein the circuitry further is configured to:

perform a separation operation, after the additional approach operation, by moving the guide members in the direction opposite to the direction to squeeze the recording media until the contact between the guide members and the recording media is not detected; and perform a re-approach operation, after the separation operation, by moving the guide members in the direction to squeeze the recording media until the contact detection unit detects the contact between the guide members and the recording media.

3. The recording medium setting device according to claim 1, wherein a number of cycles for the additional approach operation changes based on a type or a stacked amount of the recording media that are set on the base plate.

4. The recording medium setting device according to claim 1, further comprising:

a recording medium detection unit configured to detect whether the recording media are set on the base plate, wherein the circuitry is configured to move the guide members when the recording medium detection unit detects that the recording media are set on the base plate, and to stop moving the guide members when the recording medium detection unit detect that the recording media are not set on the base plate.

5. The image forming apparatus according to claim 4, wherein the circuitry is further configured to move the guide members when the image forming unit performs printing and the recording medium detection unit detects that the recording media are set on the base plate, and to stop moving the guide members when the recording medium detection unit detects that the recording media are not set on the base plate even when the image forming unit performs printing.

6. An image forming apparatus comprising:

the recording medium setting device according to claim 1; and the image forming unit.

7. The recording medium setting device according to claim 1, wherein the circuitry includes control circuitry and a drive motor.

8. A method of setting recording media in a recording medium setting device, the recording medium setting device comprising a base plate, guide members and a contact detection unit, the guide members configured to be moved in a width direction of the recording media that are set on the base plate, the contact detection unit configured to detect a contact between the guide members and the recording media, the method comprising:

first moving the guide members in a direction so as to sandwich the recording media set on the base plate until the contact detection unit detects contact between the guide members and the recording media; and second moving the guide members, after the first moving, at a predetermined distance in the direction to squeeze the recording media after the contact detection unit detects contact between the guide members and the recording media, wherein the first moving and the second moving are performed while an image forming unit configured to perform printing on the recording media fed from the recording medium setting device performs printing.

9. The method according to claim 8, further comprising:

third moving the guide members in a direction opposite to the direction to squeeze the recording media until contact between the guide members and the recording media is not detected; and moving the guide members, after the third moving, in a direction to squeeze the recording media until the contact detection unit detects contact between the guide members and the recording media.

10. The method according to claim 8, wherein a number of cycles for the second moving changes based on a type or a stacked mount of the recording media that are set on the base plate.

11. The method according to claim 8, the recording medium setting device further comprising a recording medium detection unit configured to detect whether the recording media are set on the base plate, the method further comprising moving the guide members when the recording medium detection unit detects the recording media are set on the plate, and stopping moving of the guide members when the recording medium detection unit detects that the recording media are not set on the base plate.

12. The method according to claim 11, further comprising:

moving the guide members when the image forming unit performs printing and the recording medium detection unit detects that the recording media are set on the base plate, and stopping the moving of the guide members when the recording medium detection unit detects that the recording media are not set on the base plate even when the image forming unit performs printing.

* * * * *